US009598860B2

(12) United States Patent
Davis et al.

(10) Patent No.: US 9,598,860 B2
(45) Date of Patent: Mar. 21, 2017

(54) FIREPROOF HOME AND A FIRE PROOF HEAT BARRIER SHIELD STRUCTURE

(71) Applicants: Matthew Davis, Danville, IL (US); Aaron Davis, Olney, IL (US); Logan Davis, Olney, IL (US)

(72) Inventors: Matthew Davis, Danville, IL (US); Aaron Davis, Olney, IL (US); Logan Davis, Olney, IL (US)

( * ) Notice: Subject to any disclaimer, the term of this patent is extended or adjusted under 35 U.S.C. 154(b) by 0 days.

(21) Appl. No.: 14/925,256

(22) Filed: Oct. 28, 2015

(65) Prior Publication Data

US 2016/0047120 A1 Feb. 18, 2016

Related U.S. Application Data

(60) Provisional application No. 62/171,517, filed on Jun. 5, 2015.

(51) Int. Cl.

| | |
|---|---|
| ***A62C 2/10*** | (2006.01) |
| ***E04B 1/94*** | (2006.01) |
| ***E04D 5/06*** | (2006.01) |

(52) U.S. Cl.

CPC . *E04B 1/94* (2013.01); *E04D 5/06* (2013.01)

(58) Field of Classification Search

CPC ..... E04B 1/941; E04B 1/947; E04B 2/7403; A62C 2/10; A62C 3/0257; A62C 3/0214

See application file for complete search history.

(56) References Cited

U.S. PATENT DOCUMENTS

| | | | | | |
|---|---|---|---|---|---|
| 2,365,127 | A | * | 12/1944 | Wagner | A62C 2/10 160/120 |
| 3,715,843 | A | * | 2/1973 | Ballinger | E04B 1/945 52/3 |
| 3,766,958 | A | * | 10/1973 | Mitchell | E04B 1/941 160/1 |
| 4,858,395 | A | * | 8/1989 | McQuirk | E04B 1/94 135/903 |
| 5,423,150 | A | * | 6/1995 | Hitchcock | A62C 3/0214 169/45 |
| 5,579,794 | A | * | 12/1996 | Sporta | E02D 5/801 135/115 |
| 5,608,992 | A | * | 3/1997 | Floyd | E04B 1/94 135/115 |

(Continued)

*Primary Examiner* — Brian Mattei
*Assistant Examiner* — Gisele Ford
(74) *Attorney, Agent, or Firm* — Barry Choobin; Patent 360

(57) ABSTRACT

The embodiments herein provide a fireproof barrier shield comprising the panels combined together to form a fireproof blanket placed on the building structure to protect the structure from flying embers, radiant heat and fire accidents. The panel comprises an inner heat retardant layer an outer heat reflective layer secured together using a heat resistant adhesive glue or thread. Each panel has several slots for receiving a fastener for combining the panels. The straps comprising a buckle and a belt are provided for securing the fireproof blanket to the ground using screw type anchors or stakes. The buckle is made of heat conductive material and the strap is made of fireproof threads. The perforated channels with brass or aluminum hose fittings are sewn to the inner layer to allow the water flow. The shield comprises a third layer arranged as an outer layer or an inner layer.

17 Claims, 7 Drawing Sheets

(56) References Cited

U.S. PATENT DOCUMENTS 5,748,072 A * 5/1998 Wang ..... A62C 2/06 340/286.05
5,791,090 A * 8/1998 Gitlin ..... E04H 9/14 52/23
5,829,200 A * 11/1998 Jones ..... A62C 2/10 52/3
5,860,251 A * 1/1999 Gleich ..... A62C 3/0257 52/2.18
5,862,851 A * 1/1999 Stoebich ..... A62C 2/10 160/120
6,820,373 B1 * 11/2004 Bundy, Jr. ..... E04H 9/14 52/1
6,865,852 B2 * 3/2005 Gower ..... E04H 9/14 135/90
7,392,620 B1 * 7/2008 Watson, Jr. ..... E04H 9/14 52/23
7,578,100 B2 * 8/2009 Sicurella ..... E04H 9/14 52/3
7,600,347 B2 * 10/2009 Lindstrom ..... E04H 9/14 52/155
8,146,298 B2 * 4/2012 Bush ..... A62C 2/06 428/116
8,403,070 B1 * 3/2013 Lowe ..... A62C 3/0257 169/16
9,212,500 B2 * 12/2015 Siegmund ..... E04H 9/14
2004/0035059 A1 * 2/2004 Meyer ..... A62C 3/0257 52/1
2004/0074152 A1 * 4/2004 Rogers ..... A62C 3/0214 52/3
2006/0083920 A1 * 4/2006 Schnabel ..... A62C 2/10 428/365
2006/0150533 A1 * 7/2006 Lin ..... A62C 2/10 52/79.1
2006/0277830 A1 * 12/2006 Boggs, Jr. ..... A62C 2/06 52/2.22
2008/0000648 A1 * 1/2008 Kleff ..... A62C 3/0257 169/48
2008/0001128 A1 * 1/2008 Goldberg ..... A62C 2/10 252/604
2008/0141596 A1 * 6/2008 Kelly ..... E04H 9/14 52/23
2008/0217028 A1 * 9/2008 Crumpton ..... A62C 2/10 169/48
2008/0302544 A1 * 12/2008 Eskind ..... A62C 2/065 169/51
2009/0165963 A1 * 7/2009 Nakamura ..... A62C 2/10 160/238
2009/0194297 A1 * 8/2009 Ortiz Teruel ..... A62C 2/10 169/50
2009/0250174 A1 * 10/2009 Cloninger ..... A62C 2/10 160/23.1
2010/0058695 A1 * 3/2010 Cropper ..... A62C 2/10 52/396.01
2010/0294520 A1 * 11/2010 Aguirre ..... A62C 3/0257 169/45
2011/0027500 A1 * 2/2011 Hanna ..... A62C 2/06 428/12
2011/0067891 A1 * 3/2011 Linares ..... A62C 2/10 169/48
2011/0088918 A1 * 4/2011 Gonzales ..... A62C 2/10 169/48
2012/0125546 A1 * 5/2012 Cooper ..... A62C 2/10 160/241
2012/0144756 A1 * 6/2012 Meager ..... E04H 9/16 52/1
2012/0145418 A1 * 6/2012 Su ..... A62C 3/0264 169/45
2012/0227990 A1 * 9/2012 Burnham ..... A62C 2/06 169/48
2013/0189471 A1 * 7/2013 Ashelin ..... E04B 1/941 428/76
2014/0248814 A1 * 9/2014 Handermann ..... A62C 2/06 442/321
2015/0083443 A1 * 3/2015 Thompson ..... A62C 2/10 169/45
2015/0283411 A1 * 10/2015 Weber ..... A62C 2/10 160/368.1
2015/0321033 A1 * 11/2015 Statter ..... A62C 3/0214 169/45

* cited by examiner

FIREPROOF HOME AND A FIRE PROOF HEAT BARRIER SHIELD STRUCTURE

CROSS REFERENCE TO RELATED APPLICATION

The present application is related to and claims the priority of the U.S. Provisional Patent Application with Ser. No. 62/171,517 filed on Jun. 05, 2015 with the tile, "Fireproof Home and Structure Barrier Shield" and the contents of which is included in entirety as reference herein.

BACKGROUND

Technical Field

The embodiments herein are generally related to fire protection system. The embodiments herein are particularly related to fire protection devices, accessories used for protecting building structures. The embodiments herein are more particularly related to fire protection sheet or devices used for protecting building structures without physical attachments to the building structure.

Description of the Related Art

Fire protection device is a safety device designed to extinguish fires. The fire protection device comprises a fire retardant material that is placed over a fire in order to smother it. The fire protection devices are available in various shapes and sizes, and are used for shielding animals, human, farms, building structures and the like.

The fire protection devices for building structures generally comprise a fire protection blanket that has a fire resistant material. The conventional fire protection devices for building structures includes a safety blankets that is spread over the buildings. However, the conventional fire protection devices are cumbersome and includes a lot of attachments that poses a problem while protecting the building structure during actual fire hazard.

Hence, there is a need for an improved fire protection device and a fire barrier shield that protects the building structures. Further, there is a need for a fire protection device and a fire barrier shield that protects the building structures without a need for cumbersome attachments to the building structure.

The above-mentioned shortcomings, disadvantages and problems are addressed herein and which will be understood by reading and studying the following specification.

OBJECTS OF THE EMBODIMENTS HEREIN

The primary objective of the embodiments herein is to provide a fireproof barrier shield for the building structures.

Another objective of the embodiment herein is to provide a fireproof barrier shield that does not require physical attachments for the building structures.

Yet another objective of the embodiments herein is to provide a fireproof barrier shield that is made from fireproof and retardant material that protects building structures from flying embers.

Yet another objective of the embodiments herein is to provide a fireproof barrier shield that has custom made structure specification as per the requirements.

Yet another objective of the embodiments herein is to provide a fireproof barrier shield that requires a minimum labor for erection.

Yet another objective of the embodiments herein is to provide a fireproof barrier shield comprising two layers to protect the structure against from flying embers and radiant heat.

Yet another objective of the embodiments herein is to provide a fireproof barrier shield comprising two layers comprising an outer heat reflective layer and an inner heat conductive barrier layer.

Yet another objective of the embodiments herein is to provide a fireproof barrier shield comprising an inner non-conductive layer or insulation layer.

Yet another objective of the embodiments herein is to provide a fireproof barrier shield which is not physically attached to the building structure.

Yet another objective of the embodiments herein is to provide a fireproof barrier shield comprising a plurality of panels that are fastened together with straps and buckles of the same material at the sides and are further fastened to the earth using screw type anchors and cables or straps of the same material.

Yet another objective of the embodiments herein is to provide a fireproof barrier shield comprising a panel of sufficient length or a combination of panels of sufficient length to cover the structure from the ground on one side to the ground on the opposite side thereby covering the entire building structure.

Yet another objective of the embodiments herein is to provide a fireproof barrier shield comprising a plurality of panels designed such that the combination of panels is wide enough as to cover the entire length of the building structure.

Yet another objective of the embodiments herein is to provide a fireproof barrier shield comprising a plurality of panels with an overlap on each side of every panel.

Yet another objective of the embodiments herein is to provide a fireproof barrier shield designed to be installed quickly and with minimal man power.

Yet another objective of the embodiments herein is to provide a fireproof barrier shield which does not require time consuming and strenuous installation and eliminates a use of heavy equipment and a skilled crew/technician for installation.

Yet another objective of the embodiments herein is to provide a fireproof barrier shield which is a combination of several lightweight panels that are light enough for one person to carry, handle and install.

Yet another objective of the embodiments herein is to provide a fireproof barrier shield which does not require any physical attachment to the structure.

Yet another objective of the embodiments herein is to provide a fireproof barrier shield comprises a plurality of panels that are custom made to any structural specifications.

Yet another objective of the embodiments herein is to provide a fireproof barrier shield comprising additional layer added for more protection against conducted heat.

Yet another objective of the embodiments herein is to provide a fireproof barrier shield comprising perforated channels with hose fittings that are sewn to the underside of the inner layer to allow water flow under the barrier shield to provide additional protection.

Yet another objective of the embodiments herein is to provide a fireproof barrier shield comprising stakes at the ends secure the panels to the ground firmly.

Yet another objective of the embodiments herein is to provide a fireproof barrier shield comprising panels such that the barrier shield or panels do not cover the entire structure of the building.

Yet another objective of the embodiments herein is to provide a fireproof barrier shield comprising panels such that the barrier shield or panels are designed to cover only a roof structure of the building structure.

Yet another objective of the embodiments herein is to provide a fireproof barrier shield comprising panels that are replaced easily, when the panels are damaged.

Yet another objective of the embodiments herein is to provide a fireproof barrier shield comprising panels sewn with rings that are spaced so as to allow any horizontal or vertical configuration of the panels easily.

Yet another objective of the embodiments herein is to provide a fireproof barrier shield comprising panels that are combined together with cables.

These and other objects and advantages of the embodiments herein will become readily apparent from the following detailed description taken in conjunction with the accompanying drawings.

SUMMARY

The embodiments herein provide a fireproof barrier shield for protecting a building structure from a fire accident. The fireproof barrier shield comprises a fireproof blanket for protecting the building structure, and a plurality of straps for securing the fireproof blanket to the ground. The fireproof blanket is configured to protect the building structure from flying embers and radiant heat.

According to an embodiment herein, a fireproof barrier shield is provided for protecting a building structure from a fire accident. The fireproof barrier shield comprises a plurality of panels combined together to form a fireproof blanket for protecting the building structure. The fireproof blanket is placed on the building structure. An inner layer is arranged on each of the plurality of panels and the inner layer is a heat retardant layer. An outer layer is arranged on each of the plurality of panels and the outer layer is a heat reflective layer. A plurality of slots is provided on each panel for receiving a fastener for combining the plurality of panels. A plurality of straps is provided for securing the fireproof blanket to the ground. The plurality of straps is secured to the ground using screw type anchors. The strap comprises a buckle and a belt. The buckle is made of heat conductive material and the strap is made of fireproof threads.

According to an embodiment herein, a plurality of stakes are provided instead of the screw anchors for securing the panels to the ground. The stakes are provided at the ends of the panels that are arranged to contact the ground. The stakes are designed to have a sufficient length or be long enough to prevent a lifting of the panels from the ground.

The outer layer and the inner layer are secured together using a heat resistant adhesive glue. The fireproof blanket is configured to protect the building structure from flying embers and radiant heat.

According to an embodiment herein, the outer layer is constructed from a heat-reflective material. According to an embodiment herein, the outer layer of the fireproof blanket is constructed with an aluminum foil.

According to an embodiment herein, the inner layer is constructed from a heat conductive material.

According to an embodiment herein, the inner layer provided in the panel is a non-conductive layer or an insulation layer.

According to an embodiment herein, the inner layer of the fireproof blanket is constructed from any non-flammable and non-conductive insulting cloth. The examples of the inner layer material include, but are not limited to woven silica, fiberglass, Kevlar, Needfelt and Nomenex.

According to an embodiment herein, the fireproof barrier shield further comprises a third layer provided to each panel, and the third layer is an outer layer or an inner layer.

According to an embodiment herein, the fireproof barrier shield further comprises a plurality of perforated channels attached to the inner layer to allow a water flow under the panel thereby giving an additional protection to the fireproof blanket. The perforated channel is provided with brass or aluminum hose fittings. The perforated channel provided with brass or aluminum hose fittings is sewn to the underside of the inner layer to allow the water flow under the fireproof blanket.

According to an embodiment herein, the outer layer and the inner layer are stitched together with a fire resistant thread.

According to an embodiment herein, the fireproof barrier shield further comprises a plurality of rings sewn to the panel at preset intervals, and the plurality of rings are metal rings. The plurality of metal rings are sewn to attach straps or cables or fasteners to the panel.

According to an embodiment herein, the fireproof barrier shield comprises the panels sewn with rings that are spaced or designed to allow any horizontal or vertical configuration of the panels easily.

According to an embodiment herein, each panel is configured to have a length to cover the building structure from one end to opposite end.

According to an embodiment herein, each panel is configured to have a width to cover an entire length of the building structure with a preset overlap on each side.

According to an embodiment herein, the fireproof barrier shield comprises panels such that the barrier shield or panels do not cover the entire structure of the building According to an embodiment herein, a fireproof barrier shield comprising panels is provided such that the barrier shield or panels are designed to cover only a roof structure of the building structure.

According to an embodiment herein, the overlap on each side has a preset strap anchored to the ground on opposite sides.

According to an embodiment herein, the strap is made of heat resistant material similar to that of panel.

According to an embodiment herein, the panels are customized as desired or with respect to a specification of the building structure.

According to an embodiment herein, the panel is configured to withstand a heat of 500-3000 degree Fahrenheit.

According to an embodiment herein, the outer layer of aluminum foil has a melting point of 1220 degree Fahrenheit.

According to an embodiment herein, the fireproof blanket is reusable for a number of times. The damaged panels needs to be replaced and is further used without changing the whole set up.

According to an embodiment herein, the fireproof barrier shield comprises a plurality of panels that are replaced easily, when the panels are damaged.

According to an embodiment herein, the fireproof barrier shield comprises the panels that are combined together with cables.

According to an embodiment herein, the fireproof blanket is configured to form a fireproof envelope or tent to protect the building structure or home from fire in an event of wildfires or forest fires.

According to an embodiment herein, the fireproof blanket is placed on the building structure. The fireproof blanket comprises a plurality of panels secured together through a fastener. Each panel comprises an outer layer and an inner layer. The outer layer is constructed from a heat-reflective material and the inner layer is constructed from a non-conductive material. The inner layer is constructed from an insulation material. Each panel is provided with an overlap layer. The overlap layer is provided both at an inner side of the panel and an outer side of the panel. Each overlap has a strap anchored to the ground on both the opposite sides of the building structure. According to an embodiment herein, the outer layer and the inner layer are secured together using a fire-resistant adhesive material.

According to an embodiment herein, the outer layer and the inner layer are secured together using a fireproof thread.

According to an embodiment herein, the fastener is screw type anchors and cables or buckles and straps of same material as that of panel.

According to an embodiment herein, the plurality of straps are secured to the ground using screw type anchors. The strap comprises a buckle and a belt. The buckle is constructed from a heat conductive material and the belt is made of fireproof threads.

According to an embodiment herein, a plurality of stakes are provided instead of the screw anchors for securing the panels to the ground. The stakes are provided at the ends of the panels that are arranged to contact the ground. The stakes are designed to have a sufficient length or configured to be long enough to prevent a lifting of the panels from the ground.

According to an embodiment herein, the outer layer of the fireproof blanket is constructed using an aluminum foil.

According to an embodiment herein, the inner layer of the fireproof blanket is constructed from any non-flammable and non-conductive insulting cloth. The examples of the inner layer material include, but are not limited to woven silica, fiberglass, Kevlar, Needfelt, and Nomenex.

According to an embodiment herein, an option to add an additional third layer is provided to provide protection, wherein the additional layer is an outer layer or an inner layer.

According to an embodiment herein, the fireproof barrier shield is reusable for a number of times.

According to an embodiment herein, the fireproof barrier shield comprises panels such that the barrier shield or panels do not cover the entire structure of the building According to an embodiment herein, a fireproof barrier shield comprising panels is provided such that the barrier shield or panels are designed to cover only a roof structure of the building structure.

According to an embodiment herein, the fireproof barrier shield comprises a plurality of panels that are replaced easily, when the panels are damaged.

According to an embodiment herein, the fireproof barrier shield comprises panels that are combined together with cables.

These and other aspects of the embodiments herein will be better appreciated and understood when considered in conjunction with the following description and the accompanying drawings. It should be understood, however, that the following descriptions, while indicating the preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
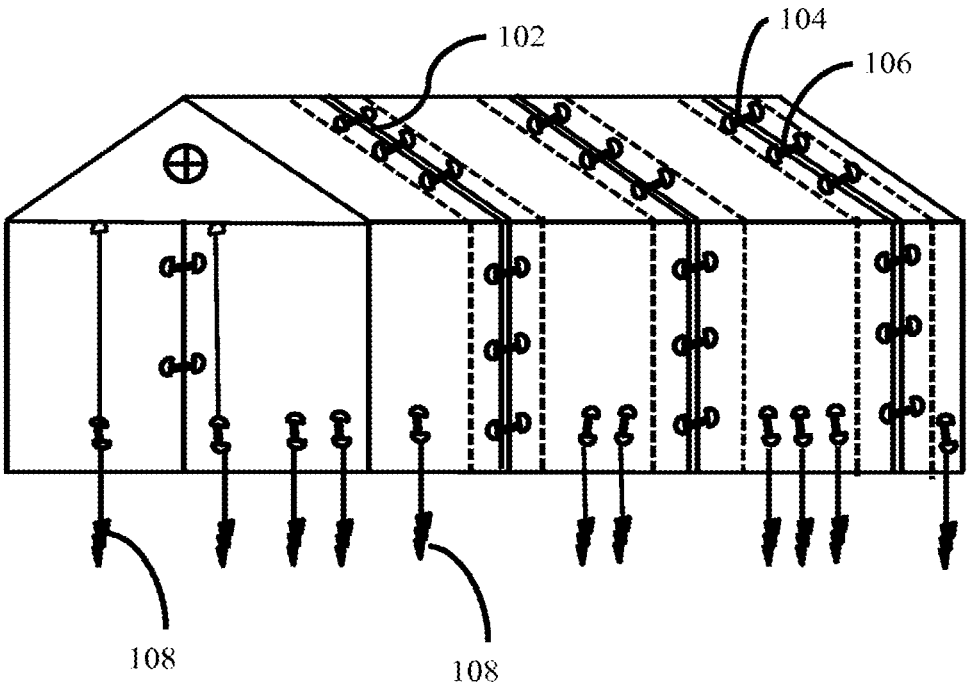
FIG. 1 illustrates a perspective view of a building structure having a fire protection device, according to an embodiment herein.

Although the specific features of the embodiments herein are shown in some drawings and not in others. This is done for convenience only as each feature may be combined with any or all of the other features in accordance with the embodiments herein.

DETAILED DESCRIPTION OF THE INVENTION

In the following detailed description, reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The embodiments herein provide a fireproof barrier shield for protecting a building structure from a fire accident. The fireproof barrier shield comprises a fireproof blanket for protecting the building structure, and a plurality of straps for securing the fireproof blanket to the ground. The fireproof blanket is configured to protect the building structure from flying embers and radiant heat.

According to an embodiment herein, a fireproof barrier shield is provided for protecting a building structure from a fire accident. The fireproof barrier shield comprises a plurality of panels combined together to form a fireproof blanket for protecting the building structure. The fireproof blanket is placed on the building structure. An inner layer is arranged on each of the plurality of panels and the inner layer is a heat retardant layer. An outer layer is arranged on each of the plurality of panels and the outer layer is a heat reflective layer. A plurality of slots is provided on each panel for receiving a fastener for combining the plurality of panels. A plurality of straps is provided for securing the fireproof blanket to the ground. The plurality of straps is secured to the ground using screw type anchors. The strap comprises a buckle and a belt. The buckle is made of heat conductive material and the strap is made of fireproof threads. The outer layer and the inner layer are secured together using a heat resistant adhesive glue. The fireproof blanket is configured to protect the building structure from flying embers and radiant heat.

According to an embodiment herein, a plurality of stakes are used instead of the screw anchors. The screw anchors long enough not to allow the plurality of panels to lift. The examples of the stakes include, but are not limited to wooden stakes, plastic stakes, metal stakes, and the like.

According to an embodiment herein, the outer layer is constructed from a heat-reflective material. According to an embodiment herein, the outer layer of the fireproof blanket is constructed with an aluminum foil.

According to an embodiment herein, the inner layer is constructed from a heat conductive material. According to an embodiment herein, the inner layer provided in the panel is a non-conductive layer insulation layer.

According to an embodiment herein, the inner layer of the fireproof blanket is constructed with a material selected from a group consisting of woven silica, fiberglass, Kevlar, Needfelt, and Nomenex.

According to an embodiment herein, the fireproof barrier shield further comprises a third layer provided to each panel, and the third layer is an outer layer or an inner layer.

According to an embodiment herein, the fireproof barrier shield further comprises a plurality of perforated channels attached to the inner layer to allow a water flow under the panel thereby giving an additional protection to the fireproof blanket. The perforated channel is provided with brass or aluminum hose fittings. The perforated channel provided with brass or aluminum hose fittings is sewn to the underside of the inner layer to allow the water flow under the fireproof blanket.

According to an embodiment herein, the outer layer and the inner layer are stitched together with a fire resistant thread.

According to an embodiment herein, the fireproof barrier shield further comprises a plurality of rings sewn to the panel at preset intervals, and the plurality of rings are metal rings. The plurality of metal rings are sewn to attach straps or cables or fasteners to the panel.

According to an embodiment herein, the fireproof barrier shield comprises the panels sewn with rings that are spaced or designed to allow any horizontal or vertical configuration of the panels easily.

According to an embodiment herein, each panel is configured to have a length to cover the building structure from one end to opposite end.

According to an embodiment herein, each panel is configured to have a width to cover an entire length of the building structure with a preset overlap on each side.

According to an embodiment herein, the fireproof barrier shield comprises panels such that the barrier shield or panels do not cover the entire structure of the building According to an embodiment herein, a fireproof barrier shield comprising panels is provided such that the barrier shield or panels are designed to cover only a roof structure of the building structure.

According to an embodiment herein, the overlap on each side has a preset strap anchored to the ground on opposite sides.

According to an embodiment herein, the strap is made of heat resistant material similar to that of panel.

According to an embodiment herein, the panels are customized as desired or with respect to a specification of the building structure.

According to an embodiment herein, the panel is configured to withstand a heat of 500-3000 degree Fahrenheit.

According to an embodiment herein, the outer layer of aluminum foil has a melting point of 1220 degree Fahrenheit.

According to an embodiment herein, the fireproof blanket is reusable for a number of times.

According to an embodiment herein, the fireproof barrier shield comprises panels such that the barrier shield or panels do not cover the entire structure of the building According to an embodiment herein, a fireproof barrier shield comprising panels is provided such that the shield or panels are designed to cover only a roof structure of the building structure.

According to an embodiment herein, fireproof barrier shield comprises a plurality of panels that are replaced easily, when the panels are damaged.

According to an embodiment herein, the fireproof barrier shield comprises the panels sewn with rings that are spaced or designed to allow any horizontal or vertical configuration of the panels easily.

According to an embodiment herein, the fireproof barrier shield comprises panels that are combined together with cables.

According to an embodiment herein, the fireproof blanket is configured to form a fireproof envelope or tent to protect the building structure or home from fire in an event of wildfires or forest fires.

According to an embodiment herein, the fireproof blanket is placed on the building structure. The fireproof blanket comprises an outer layer and an inner layer. The outer layer is constructed from a heat-reflective material, and the inner layer is constructed from a non-conductive, insulating material.

According to an embodiment herein, the outer layer and the inner layer are secured together using a fire-resistant adhesive. According to an embodiment herein, the outer layer and the inner layer are secured together using a fireproof thread.

According to an embodiment herein, the plurality of straps are secured to the ground using screw type anchors. The strap comprises a buckle and a belt. The buckle is constructed from a heat conductive material and the belt is made of fireproof threads.

According to an embodiment herein, a plurality of stakes are used instead of the screw anchors. The screw anchors long enough not to allow the plurality of panels to lift. The examples of the stakes include, but are not limited to wooden stakes, plastic stakes, metal stakes, and the like.

According to an embodiment herein, the outer layer of the fireproof blanket is constructed using an aluminum foil.

According to an embodiment herein, the inner layer of the fireproof blanket is constructed from any non-flammable and non-conductive insulting cloth. The examples of the inner layer material include, but are not limited to woven silica, fiberglass, Kevlar, Needfelt, and Nomenex.

According to an embodiment herein, an option to add an additional third layer is provided to provide protection. The additional layer is an outer layer or an inner layer.

According to an embodiment herein, the fireproof barrier shield is reusable for a number of times.

According to an embodiment herein, the fireproof barrier shield does not require any physical attachment of the shield to the building structure.

According to an embodiment herein, the fireproof barrier shield is comprised of multiple panels that are fastened together with straps and buckles of the same material at the sides. The multiple panels are fastened to the earth using screw type anchors and cables or straps of the same material. Each panel or a combination of panels is of sufficient length to cover the building structure from the ground on one side to the ground on the opposite side. The combination of panels is wide enough to cover the entire length of the building structure with a preset (4 to 6 inch) overlap on each side of each panel. Each overlap has strap of preset size (of 2 to 4 inch). The strap is made of the same material as that of the panel or fireproof material. The strap is anchored to the ground on opposite sides. The panels/fire protection panels are custom made or customized as per the specifications of the building structure or as desired.

The barrier shield is a two layer structure. The outer layer is a radiant heat reflective layer such as aluminum layer and the inner layer is a non-conductive heat barrier layer. The barrier shield as a whole protects the building structure from the flying embers and radiant heat The barrier shields are constructed with layers of aluminum foil, woven silica, and fiberglass. The barrier shields are also constructed of the inner layers made up of materials selected from a group consisting of Kevlar, Nomenex and Needle felt, woven silica and fiberglass. However, the outer layer is always made of aluminum foil.

According to an embodiment herein, the barrier shield has an outer layer which is a heat reflection layer. The heat reflection outer layer is always an aluminum foil. The barrier shield is configured to withstand a maximum heat capacity based on the material used for the inner layer and the heat range is between 500 and 3000 degree F. The outer layer of aluminum foil has a melting point of 1220 degree F.

According to an embodiment herein, the heat barrier shield is constructed of multiple layers of fireproof material with an outer aluminum foil layer. The outer layer and the inner layer are bonded together with a heat resistant adhesive glue or stitched together using a fire resistant thread. The barrier shield have metal rings sewn into it at preset intervals of 12 inches for attachment or securement of straps and or cables. The building structures to be protected are those built of traditional materials, such as Homes, detached garages, outer buildings, etc.

According to an embodiment herein, the panels or fire protection panels are customized based on the specifications of the building structure or the panels or fire protection panels are custom made to the specifications of any building structure. A third layer is be added to the barrier shield for more protection against conducted heat. a plurality of perforated channels with brass or aluminum hose fittings are sewn to the underside of the inner layer to allow a water flow under the barrier shield thereby giving added/additional protection.

According to an embodiment herein, the heat barrier shield is designed to be installed quickly and with minimal man power. The heat barrier shield is a combination of several lightweight panels that are light enough to be carried and handled by one/single person. The heat barrier shield does not require any physical attachment to the building structure in any way.

The embodiments herein discloses a lightweight, reusable home and barrier heat shield comprising a plurality of panels. The panels are made of a non-flammable, fire retardant, and heat reflective material. The heat barrier shield is installed over existing homes and structures without any physical attachment to the home or construction. The heat barrier shield does not require the usage of tacks, staples, screws, nails, firing strips, etc. The barrier shield uses straps of the same material and steel cables secured into the ground with buckles and ratcheting straps attached to screw type anchors and clamps. According to an embodiment herein, a plurality of stakes are used instead of the screw anchors. The screw anchors long enough not to allow the plurality of panels to lift. The examples of the stakes include, but are not limited to wooden stakes, plastic stakes, metal stakes, and the like.

According to an embodiment herein, the fireproof barrier shield comprises panels such that the barrier shield or panels do not cover the entire structure of the building According to an embodiment herein, a fireproof barrier shield comprises panels such that the barrier shield or panels are designed to cover only a roof structure of the building structure.

According to an embodiment herein, fireproof barrier shield comprises a plurality of panels that are replaced easily, when the panels are damaged.

According to an embodiment herein, the fireproof barrier shield comprises the panels sewn with rings that are spaced or designed to allow any horizontal or vertical configuration of the panels easily.

According to an embodiment herein, the fireproof barrier shield comprises panels that are combined together with cables.

The heat barrier shield creates a fireproof envelope or tent to protect the structure or home from fire in the event of wildfires or forest fires. In addition, the heat barrier shield comprising the fireproof and retardant material is configured to protect the home or structures surface from flying embers. The heat barrier shield comprising the heat reflective material is configured to protect from radiant heat. The heat barrier shield does not require tacks, staples, screws, nails, firing strips, etc., for combining a plurality of panels.

FIG. 1 illustrates a perspective view of a building structure having a fire protection device of fire proof barrier shield, according to an embodiment herein. A fireproof blanket saves the building structure from a hazardous accident such as wildfire.

According to an embodiment herein, the fireproof barrier shield does not require any physical attachment to the building structure. The fireproof barrier shield is comprised of a plurality of panels 102 that are fastened together with straps 104 and buckles 106 at the sides of the building structure and fastened to the earth using a screw type anchor 108. A fireproof blanket is placed on the building structure with the panels 102 and secured to the ground using the straps 104 and the buckles 106. According to an embodiment herein, a panel of the fireproof barrier shield overlaps at the edges and the corners of the building structures and unfolds to cover the ends of the building structure.

According to an embodiment herein, each panel or a combination of panels is of sufficient length to cover the entire length of the building structure with a standard overlap. According to an embodiment herein, the panel length is customizable based on the size of the building structure. According to an embodiment herein, each overlap has a 2 to 4 inch strap of the same material anchored to the ground on the opposite sides.

According to an embodiment herein, the fireproof barrier shield is a two-layer device. The outer layer is a made up of a radiant heat reflective material. The inner layer is made up of a non-conductive, insulated, heat barrier material. According to an embodiment herein, the combination of the outer layer and the inner layer of the fireproof barrier shield protects the building structure from flying embers and the radiant heat.

According to an embodiment herein, the barrier shields are constructed using materials such as aluminium foil, woven silica, fiberglass, and the like. The outer-layer is always the aluminium foil, whereas the inner layer are made up of materials such as Kevlar, Nomenex, and Needfelt.

According to an embodiment herein, the fireproof barrier shield is constructed of multiple layers of material with an aluminium foil as the outer layer. The outer layer of the fireproof barrier shield is bonded with the inner layer using a heat resistant adhesive glue. According to an embodiment herein, the outer layer of the fireproof barrier shield is stitched to the inner layer using a fire resistant thread.

According to an embodiment herein, the fireproof shield barrier has metal buckles sewn at regular intervals for attachments or securing a plurality of straps and cables. According to an embodiment herein, the fireproof shield barrier protects the building structures such as homes, detached garages, outer buildings, and the like.

According to an embodiment herein, an option is provided to add a third layer to increase the fireproof capacity of the fireproof barrier shield. A third layer is added for providing more protection against conductive heat. According to an embodiment herein, the perforated channels with brass or aluminum hose fittings are sewn to the underside of the inner layer of the fireproof barrier shield to allow a water flow, which gives additional protection.

According to an embodiment herein, the heat range of the fireproof barrier shield varies between 500 and 3000 degree Fahrenheit depending upon the inner material used. Further, the heat range of the fireproof barrier also depends on the melting point of the outer layer material such as aluminum. The typical melting point of the aluminum is 1220 degree Fahrenheit.

Figure 2:
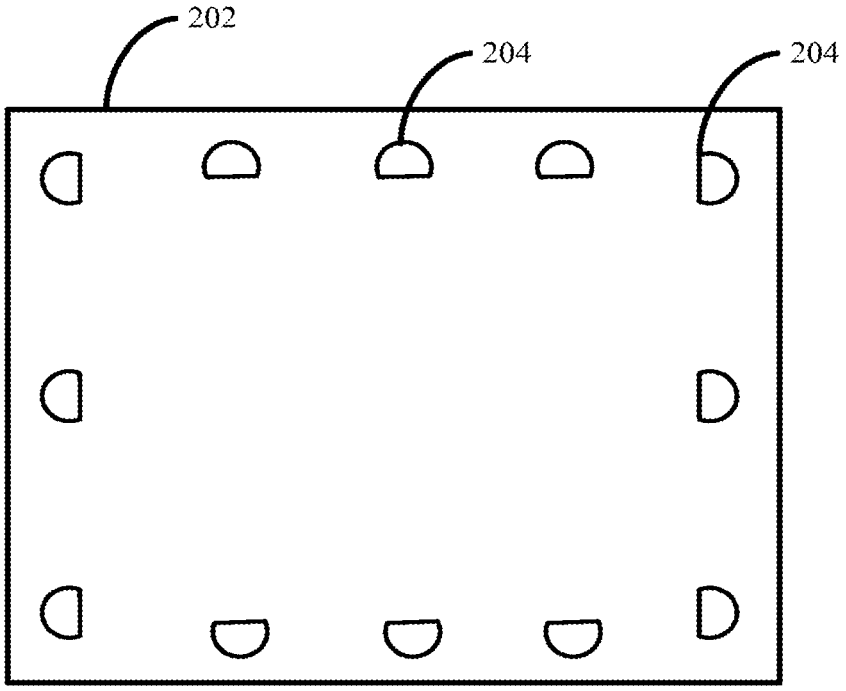
FIG. 2 illustrates a front view of a panel which is a fire protection panel of the fire protection/barrier shield, according to an embodiment herein.

FIG. 2 illustrates a front view of a fire protection panel of the fire protection shield, according to an embodiment herein. The panel that is a fire protection panel 202 acts as the fireproof barrier shield and is laid on the building structures. When the fireproof barrier shield/panel is laid on the building structure, an envelope or tent like structure is formed to protect the building structure from fire. Each panel has a plurality of slots or holes for receiving a plurality of fasteners such as buckles or screw type fasteners or fire proof threads. The buckles are fastened in the plurality of slots 204. The fastening of the buckles in the plurality of slots 204 is an easy process and does not require more than one personnel. According to an embodiment herein, the panel 202 is customizable according to the requirements of the user.

According to an embodiment herein, the number of slots 204 in the panel for fastening the buckles are customizable based on the size of the building structure.

Figure 3:
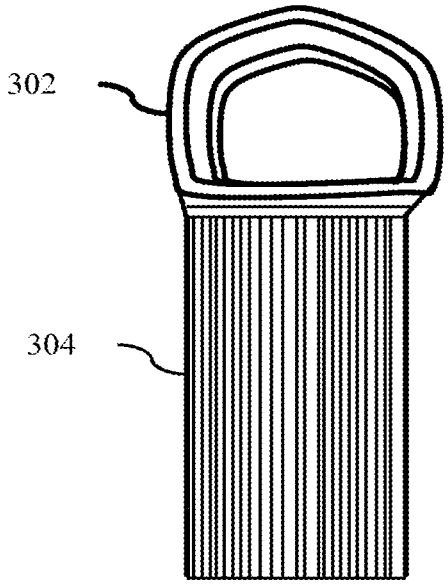
FIG. 3 illustrates a straps used as a fire protection shield according to an embodiment herein.

FIG. 3 illustrates a front view of a buckle and strap used for fastening the fire protection panels in the fire protection shield, according to an embodiment herein. The strap includes a buckle 302, and a belt 304. According to an embodiment herein, the buckle 302 is used for fastening the straps on the fireproof shield barrier to the panels or to the ground.

With respect to FIG. 3, the buckle 302, and the belt 304 are made of fireproof material. A plurality of straps from the fireproof shield barrier is secured to the ground using screw type anchors and clamps thereby creating a fireproof envelope or a tent.

Figure 4:
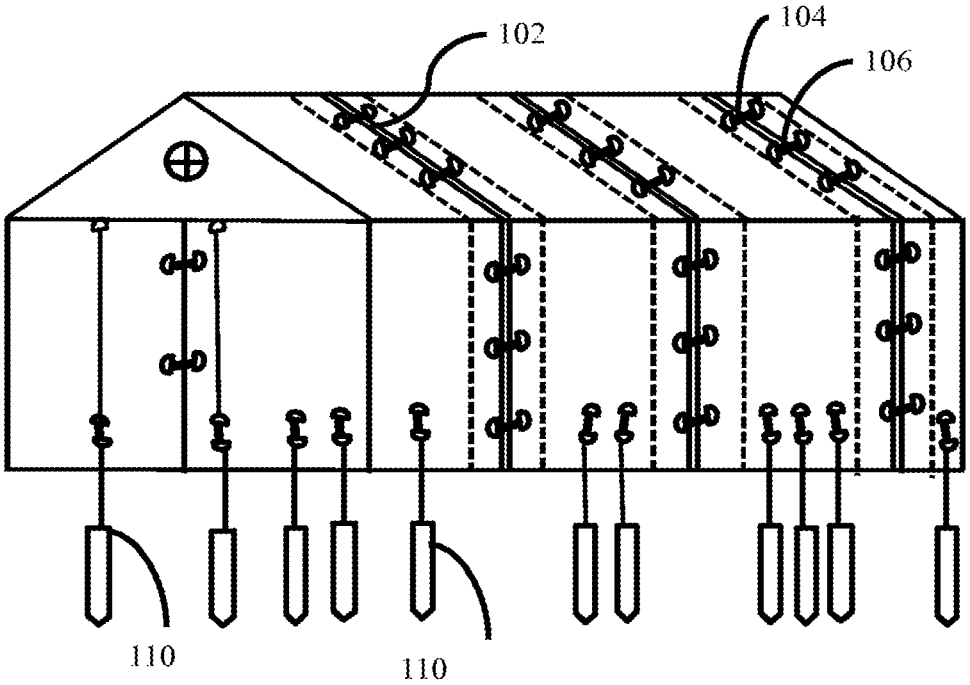
FIG. 4 illustrates a perspective view of a building structure having a fire protection/barrier shield with stakes, according to an embodiment herein.

FIG. 4 illustrates a perspective view of a building structure having a fire protection device with stakes, according to an embodiment herein. With respect to FIG. 4, the plurality of straps 104 and the buckles 106 are fastened with a plurality of stakes 110. The panels are provided with a plurality of stakes for anchoring the panels to the ground. The stakes are provided at the ends of the panels that are anchored to the ground. According to an embodiment herein, the plurality of stakes are used instead of the screw anchors. The stakes are designed to be long enough to prevent the lifting of the plurality of panels anchored to the ground. The examples of the stakes include, but are not limited to wooden stakes, plastic stakes, metal stakes, and the like.

Figure 5:
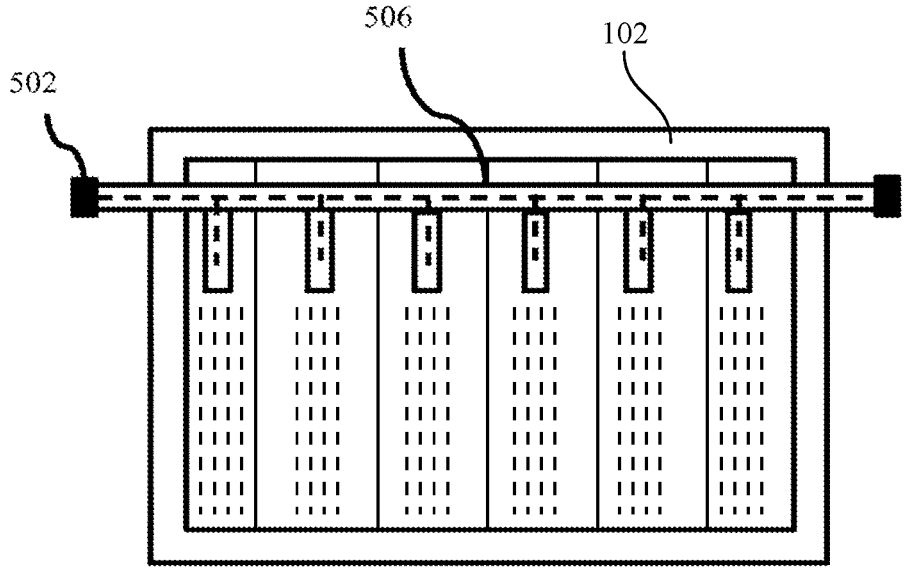
FIG. 5 illustrates a bottom view of the panel mounted with a water channel in fire protection/barrier shield, according to an embodiment herein.

FIG. 5 illustrates a bottom view of the panel mounted with a water channel, according to an embodiment herein. With respect to FIG. 5, the panels are mounted with one or more channels for allowing a water flow. The garden hose is connected to the ends of the channels to allow a water flow. The water channel 504 is attached to the inner layer of the fireproof barrier shield. The water channel 504 is controlled using a water controller 502. The water flow channel 504 allows the water to flow through the building structure when the water channel 502 is released. The water channel 506 gives additional protection to the fireproof blanket. The perforated channel is provided with brass or aluminum hose fittings. The perforated channel provided with brass or aluminum hose fittings is sewn to the underside of the inner layer to allow the water flow under the fireproof blanket.

Figure 6:
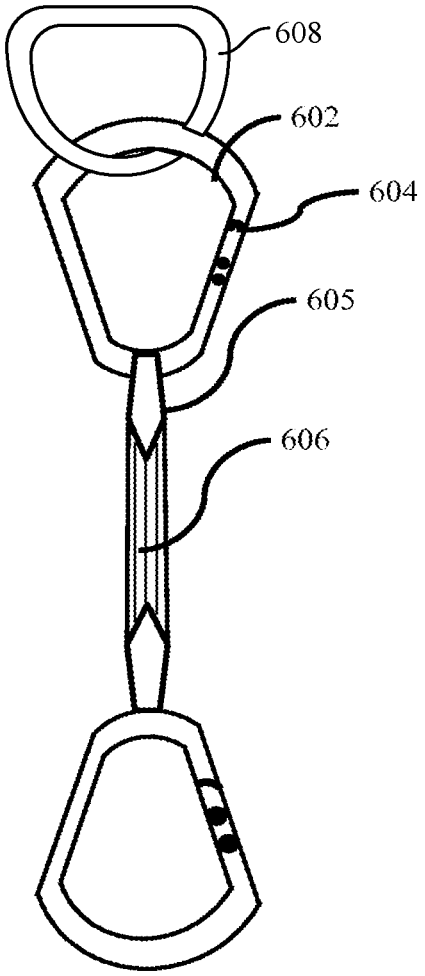
FIG. 6 illustrates a front view of a cable strap included between the outer layer and the inner layer of the fire protection device, according to an embodiment herein.

FIG. 6 illustrates a cable strap included between the outer layer and the inner layer of the fire protection device, according to an embodiment herein. With respect to FIG. 6, the cable strap comprises the steel holder 602, the quick clip 604, and the fireproof strap 606. The fireproof strap is constructed from steel cable for providing strength to the cable strap. The cable strap is connected to the D-rings 608. The steel holder 602 and the fireproof strap 606 are connected using the pear clip 605. The steel holder 602 of cable straps are secured to the D-rings 608 using the quick clip 604.

Figure 7A:
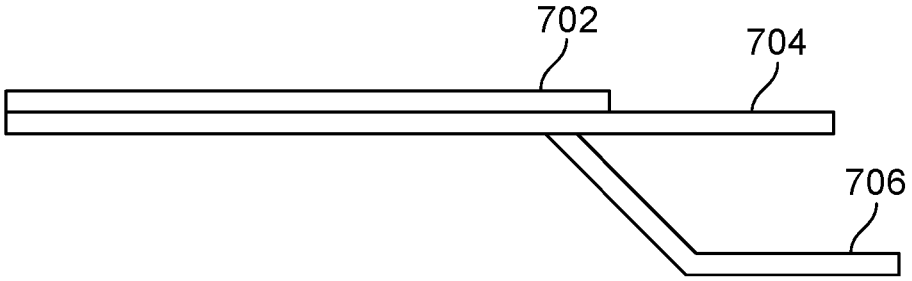
FIG. 7 illustrates a side view of the overlapping flaps of the fire protection device, according to an u embodiment herein.
Figure 7B:
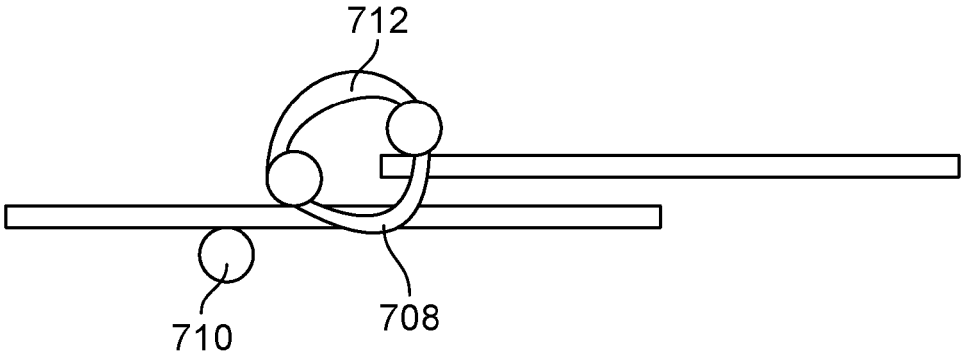

FIG. 7 illustrates a side view of the overlapping flaps of the fire protection device, according to an embodiment herein. With respect to FIG. 7, the cable straps with the buckle 712 are placed in between the ground and the building structure. The fireproof blanket comprises an outer layer 702 and the inner layer 704. The outer layer 702 is constructed from a fire radiant barrier such as Aluminium. The inner layer 704 is constructed from a heat non-conductive material such as Kevlar, Needfelt and the like. With respect to FIG. 7, the overlapping layer 706 is provided. The cable strap with the buckle 712 is placed between the ground and the building structure. A hose fitting 710 is used for securing the fireproof blanket to the ground using stakes or panels.

The embodiments here provide a plurality of stakes instead of the screw anchors for anchoring the panels to the ground. The screw anchors long enough not to allow the plurality of panels to lift. The examples of the stakes include, but are not limited to wooden stakes, plastic stakes, metal stakes, and the like.

The embodiments herein provide a fireproof barrier shield that does not require physical attachment to the building structure.

The embodiments herein provide a fireproof barrier shield that is designed to be installed quickly and with minimal labor.

The embodiments herein provide a fireproof barrier shield that is reusable for multiple times.

The embodiments herein provide a fireproof heat barrier shield that does not require tacks, staples, screws, nails, firing strips, etc., for combining a plurality of panels.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

What is claimed is:

1. A fireproof barrier shield for protecting a building structure from a fire accident, the fireproof barrier shield comprising:

a plurality of panels combined together to form a fireproof blanket for protecting the building structure, wherein the fireproof blanket is placed on the building structure, wherein each of the plurality of panels comprising an inner layer and an outer layer, wherein each panel has a plurality of slots for receiving a plurality of fasteners to attach another panel, thereby allowing customizable attachment of panels according to size of the building structure;

wherein the inner layer is a heat retardant layer;

wherein the outer layer is a heat reflective layer;

a plurality of straps for securing the fireproof blanket to a ground, wherein the plurality of straps are secured to the ground, and wherein the strap comprises a buckle and a belt, and wherein the buckle is made of heat conductive material and wherein the strap is made of fireproof threads; wherein the outer layer and the inner layer are secured together, wherein the fireproof blanket is configured to protect the building structure from flying embers and radiant heat;

the plurality of fasteners comprising a cable strap connected through the outer layer and the inner layer, wherein the cable strap comprises a steel holder, a quick clip, and a fireproof strap, wherein the fireproof strap is made of steel cable, and the cable straps are connected to each other via D shaped rings, wherein each steel holder and each fire proof strap is connected using a pear clip, and each steel holder is secured to each D shaped ring via the quick clip.

2. The fireproof barrier shield according to claim 1, wherein the outer layer is constructed from a heat-reflective material, and wherein the inner layer is constructed from a non-heat conductive material.

3. The fireproof barrier shield according to claim 1, wherein the outer layer of the fireproof blanket is constructed with an aluminum foil.

4. The fireproof barrier shield according to claim 1, wherein the inner layer of the fireproof blanket is constructed with a material selected from a group consisting of high spun aramid fibers, woven silica, and fiberglass.

5. The fireproof barrier shield according to claim 1 further comprises a third layer provided to each panel, wherein the third layer is one of an outer layer and an inner layer.

6. The fireproof barrier shield according to claim 1 further comprises a plurality of perforated channels attached to the inner layer to allow a water flow under the panel thereby giving an additional protection to the fireproof blanket.

7. The fireproof barrier shield according to claim 6, wherein each perforated channel is provided with brass or aluminum hose fittings, and wherein the perforated channel provided with brass or aluminum hose fittings is sewn to an underside of the inner layer to allow the water flow under the fireproof blanket.

8. The fireproof barrier shield according to claim 1, wherein the outer layer and the inner layer are one of bonded together with a heat resistant adhesive glue, and stitched together using a fire-resistant thread.

9. The fireproof barrier shield according to claim 1, wherein each panel is configured to have a length to cover the building structure from one end to an opposite end.

10. The fireproof barrier shield according to claim 1, wherein each panel is configured to have a width to cover an entire length of the building structure with a preset overlap between on each side of each panel.

11. The fireproof barrier shield according to claim 1, wherein at least one of the plurality of panels is capable of covering only a portion of the building, the portion capable of being a roof.

12. The fireproof barrier shield according to claim 1, wherein each overlap has a strap of same material as one of the plurality of straps anchored to the ground on opposite sides, and wherein the strap is made of heat resistant material.

13. The fireproof barrier shield according to claim 1, wherein the plurality of panels are anchored to the ground through a plurality of stakes, and wherein the plurality of stakes are designed to have a length to prevent a lifting of the panels from the ground after the panels are anchored to the ground.

14. The fireproof barrier shield according to claim 1, wherein the panel is configured to withstand a heat of 500-3000 degree Fahrenheit, and wherein the outer layer of aluminum foil has a melting point of 1220 degree Fahrenheit.

15. The fireproof barrier shield according to claim 1, wherein the fireproof blanket is reusable for a number of times.

16. The fireproof barrier shield according to claim 1, wherein the fireproof blanket is configured to form a fireproof envelope or tent to protect the building structure or home from fire in an event of wildfires or forest fires.

17. The fireproof barrier shield according to claim 1, wherein the plurality of straps are secured to the ground using screw type anchors.

* * * * *